US007665996B2

(12) United States Patent
Jaeger

(10) Patent No.: US 7,665,996 B2
(45) Date of Patent: Feb. 23, 2010

(54) ROTATING POWER CONNECTOR FOR ELECTRIC WELDING TORCH UNICABLES

(75) Inventor: Thomas Jaeger, Pointe Aux Roches (CA)

(73) Assignee: Illinois Tool Works Inc., Glenview, IL (US)

( * ) Notice: Subject to any disclaimer, the term of this patent is extended or adjusted under 35 U.S.C. 154(b) by 122 days.

(21) Appl. No.: 11/968,956

(22) Filed: Jan. 3, 2008

(65) Prior Publication Data

US 2008/0188093 A1 Aug. 7, 2008

Related U.S. Application Data

(60) Provisional application No. 60/899,301, filed on Feb. 2, 2007.

(51) Int. Cl.
*H01R 39/00* (2006.01)

(52) U.S. Cl. ..... 439/13; 439/289; 439/294

(58) Field of Classification Search ..... 439/13, 439/289, 293–295, 271
See application file for complete search history.

(56) References Cited

U.S. PATENT DOCUMENTS 3,909,585 A * 9/1975 Sanders et al. ..... 219/137.51
4,336,974 A 6/1982 Wilson
4,549,068 A 10/1985 Kensrue
4,892,990 A 1/1990 Acheson
5,338,917 A * 8/1994 Stuart et al. ..... 219/137.63
5,440,100 A * 8/1995 Stuart et al. ..... 219/137.31
5,491,321 A * 2/1996 Stuart et al. ..... 219/137.61
5,916,465 A * 6/1999 New et al. ..... 219/138

FOREIGN PATENT DOCUMENTS

EP 0283745 9/1988
GB 1403225 8/1975

* cited by examiner

*Primary Examiner*—Tho D Ta
*Assistant Examiner*—Travis Chambers
(74) *Attorney, Agent, or Firm*—Fildes & Outland, P.C.

(57) ABSTRACT

A rotating power connector for an electric welding torch unicable includes a generally cylindrical outer housing having a longitudinal axis. A connector pin is fixedly, axially disposed within the outer housing and extends from one end thereof. A rotating stud is rotatably, axially disposed within the outer housing and extends from another end thereof. The connector pin and the rotating stud have ends in contact within the outer housing. A secondary electrical contact ring also is disposed within the outer housing. The secondary electrical contact ring includes at least one contact portion contacting the rotating stud. At least one biasing member is disposed between the rotating stud and the contact ring. The biasing member urges the rotating stud into engagement with the connector pin and urges the contact ring into engagement with the rotating stud.

16 Claims, 5 Drawing Sheets

ROTATING POWER CONNECTOR FOR ELECTRIC WELDING TORCH UNICABLES

CROSS REFERENCE TO RELATED APPLICATION

This application claims the priority of U.S. Provisional Application No. 60/899,301 filed Feb. 2, 2007.

TECHNICAL FIELD

This invention relates to electric welding and specifically to a rotating power connection for connecting an electrical supply power cable to an electric welding torch.

BACKGROUND OF THE INVENTION

In an electric welding process, it is known to use a power cable for conducting current and sometimes shielding gas to a welding torch. The power cable is often referred to as a unicable, which generally includes a core tube, copper cabling and shielded lead wires. Typically, such a cable is connected to each end of a MIG torch by way of either a crimped style fitting or a threaded compression fitting. One end of the cable is fastened to a wire feeder by way of a mating pin, and the other end is fastened to a gooseneck or conductor tube of the welding torch. These connections are fixed and unmoving.

The conventional fixed connection limits the torsional movement of the copper bundles within the unicables and creates stress, leading to eventual failure of the electrical connection of the welding torch. Current designs of cables in the industry are installed in fixed positions, and during manipulation of the torch by a user or robot, the cable twists as the torch is turned. In newer robotic designs, this becomes problematic as the cable can be subjected to severe mechanical wear such that the fixed cable connections fail.

There are also several models of robots in the market that allow for a coaxial mounting of the welding torch. This means that the torch cable runs through the center axis of the robot. In the case of a coaxial mounted welding torch, any rotation of the robot axis that is coaxial with the cable puts rotational torque on the cable, thereby creating mechanical wear.

SUMMARY OF THE INVENTION

The present invention provides a rotating power connection that may be affixed either at the front of a torch behind the gooseneck position or at the rear of the torch before the power connection to a wire feeder. The present invention advantageously allows for rotation of the welding torch relative to the unicable. The rotating power connection is connected to a unicable of the torch. When the torch is mounted on a robot arm, the rotating power connection allows the unicable to rotate with the axis of rotation of the robot, thereby eliminating any torque in the unicable and reducing mechanical wear of the unicable.

More particularly, a rotating power connector for an electric welding torch unicable in accordance with the invention includes a generally cylindrical outer housing having a longitudinal axis. A connector pin is fixedly, axially disposed within the outer housing and extends from one end thereof. A rotating stud is rotatably, axially disposed within the outer housing and extends from another end thereof. The connector pin and the rotating stud have ends in contact within the outer housing. A secondary electrical contact ring is also disposed within the outer housing. The secondary electrical contact ring includes at least one contact portion contacting the rotating stud. For example, the contact ring may include eight contact portions contacting the rotating stud. At least one biasing member is disposed between the rotating stud and the contact ring. The biasing member urges the rotating stud into engagement with the connector pin and urges the contact ring into engagement with the rotating stud.

In one embodiment, the rotating stud and the connector pin may be in electrical contact such that the electric current flows therethrough. The connector pin may be insertable into a welding torch to connect the rotating power connector to the welding torch. The rotating stud may be connectable to an electric welding torch unicable.

The rotating power connector may further include a slip ring on the rotating stud. One biasing member may be disposed between the slip ring and a portion of the rotating stud to urge the rotating stud into engagement with the connector pin. Another biasing member may be disposed between the slip ring and the contact ring to urge the contact ring into engagement with the rotating stud. The biasing members may be wave springs.

The rotating power connector may also include an inner housing disposed inside of the outer housing and generally over the outer housing and the rotating stud and connector pin. The inner housing may include a tapered surface in contact with the at least one contact portion of the contact ring. The tapered surface urges the at least one contact portion into engagement with the rotating stud. The inner housing may contact the connector pin and the at least one contact portion of the contact ring to allow for the flow of electric current from the rotating stud through the contact ring and the inner housing into the connector pin.

A bearing may be disposed around the rotating stud to facilitate rotation of the rotating stud relative to the connector pin.

In an alternative embodiment, an assembly for rotational movement of an electric welding torch unicable includes a connector that rotatably connects a welding torch unicable to a welding torch such that the unicable is rotatable relative to the welding torch. The unicable, connector, and welding torch are in fluid communication, are electrically connected, and cooperate to define a passageway for a welding material.

In a specific embodiment, the connector may communicate electrical current from the unicable to the welding torch. The connector may also communicate shielding gas from the unicable to the welding torch. The connector may include a housing and a rotating member received in the housing. The rotating member is rotatable relative to the housing and is connectable to the unicable.

These and other features and advantages of the invention will be more fully understood from the following detailed description of the invention taken together with the accompanying drawings.

DETAILED DESCRIPTION OF THE INVENTION

Figure 1:
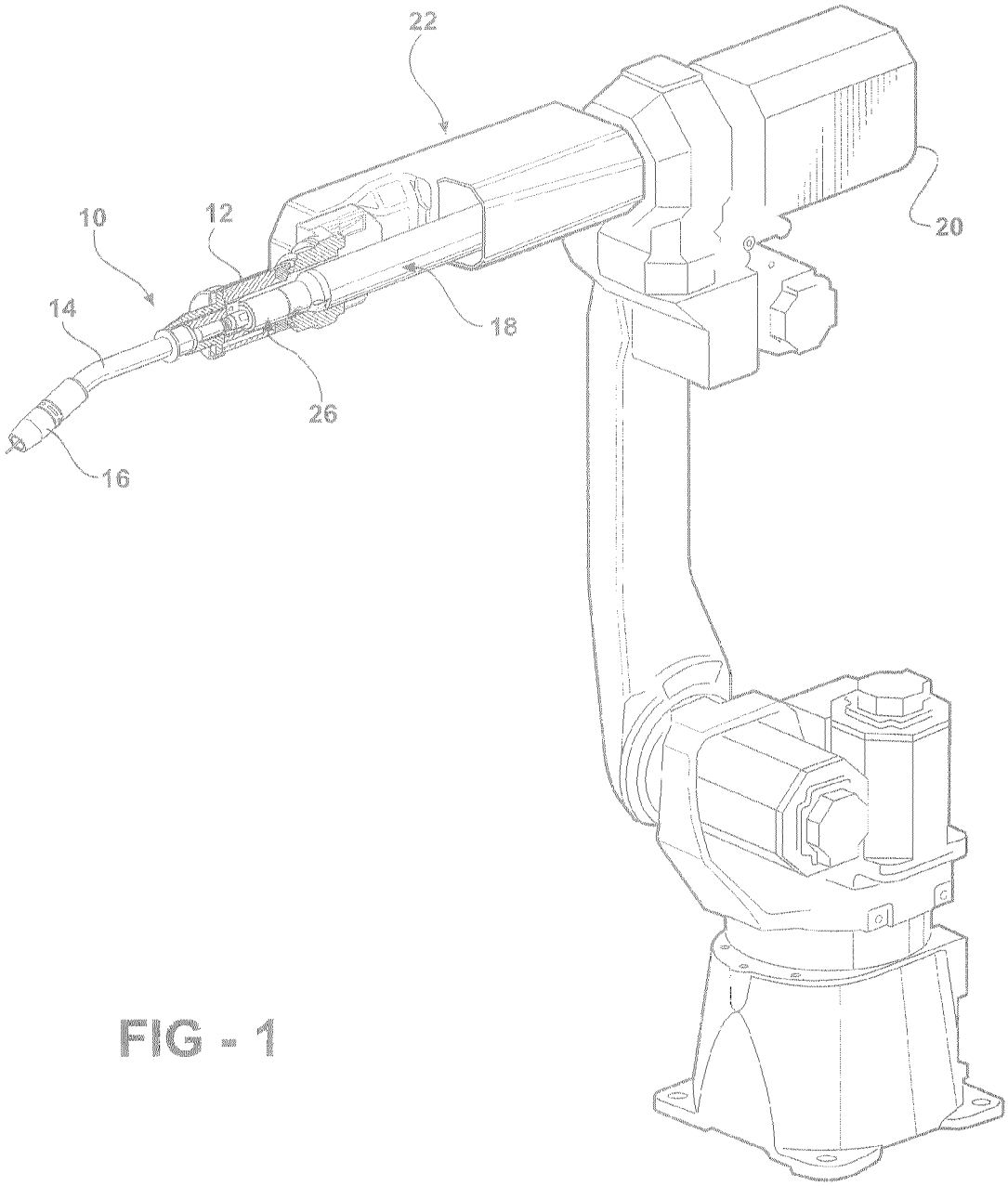
FIG. 1 is an environmental view of a welding torch coaxially mounted on a robot arm, and a unicable assembly plugged into the welding torch along an axis of the robot arm.

Referring now to the drawings in detail, numeral 10 generally indicates an electric welding torch such as a gas metal arc welding (GMAW) torch, a metal inert gas (MIG) torch, or similar welding torch. The welding torch 10 includes a main housing 12, a gooseneck 14, and a contact tip assembly 16. An electric power cable such as a unicable assembly 18 is connected to a rearward end of the main housing 12 to supply gas, electrical current, and a consumable electrode (e.g., a metal welding wire) to the torch 10. The unicable assembly 18 generally includes a core tube, copper cabling, and shielded lead wires. The unicable 18 may be connected to a wire feeder 20 opposite the main housing 12 of the welding torch 10. The gooseneck 14 is operatively connected to a forward end of the main housing 12 and allows for the communication of the consumable electrode, the shielding gas, and the welding current to the contact tip assembly 16 mounted on the gooseneck. The welding torch 10 is coaxially mounted to a robotic arm 22 such that the unicable 18 is disposed along the center axis of the robotic arm. However, the welding torch 10 may be mounted to a robotic arm in a disposition other than a coaxially mounted disposition.

The wire feeder 20 feeds the welding wire through the unicable 18 into the welding torch 10, and ultimately through an orifice in the contact tip assembly 16 at the forward end of the welding torch. The welding wire, when energized for welding, carries a high electrical potential. When the welding wire makes contact with target metal workpieces, an electrical circuit is completed and current flows through the welding wire, across the metal workpieces and to ground. The current causes the welding wire and the metal of the workpieces in contact with the welding wire to melt, thereby joining the workpieces as the melt solidifies.

Figure 2:
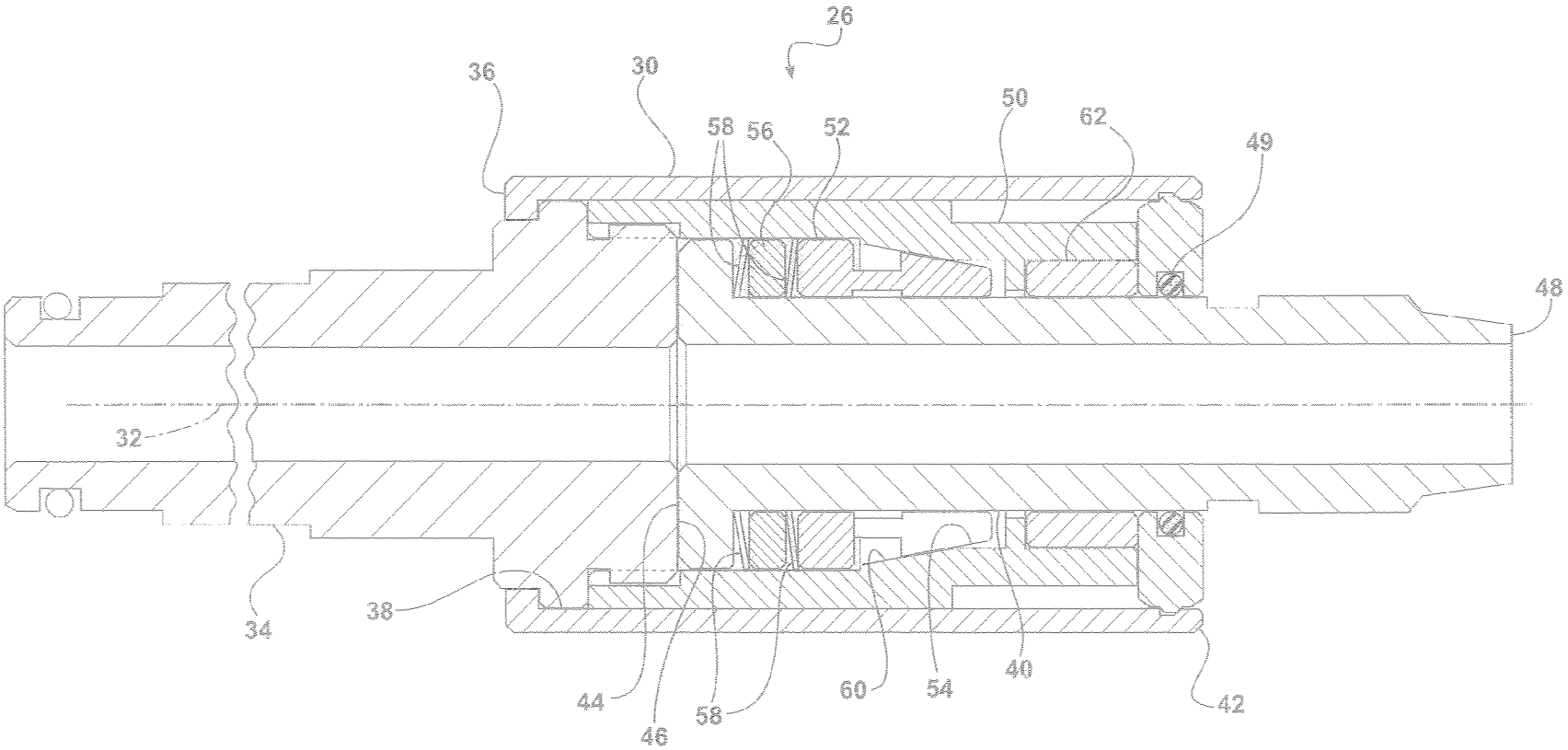
FIG. 2 is a perspective, sectional view of a rotating power connector in accordance with the invention for connecting the unicable assembly to the welding torch.
Figure 3:
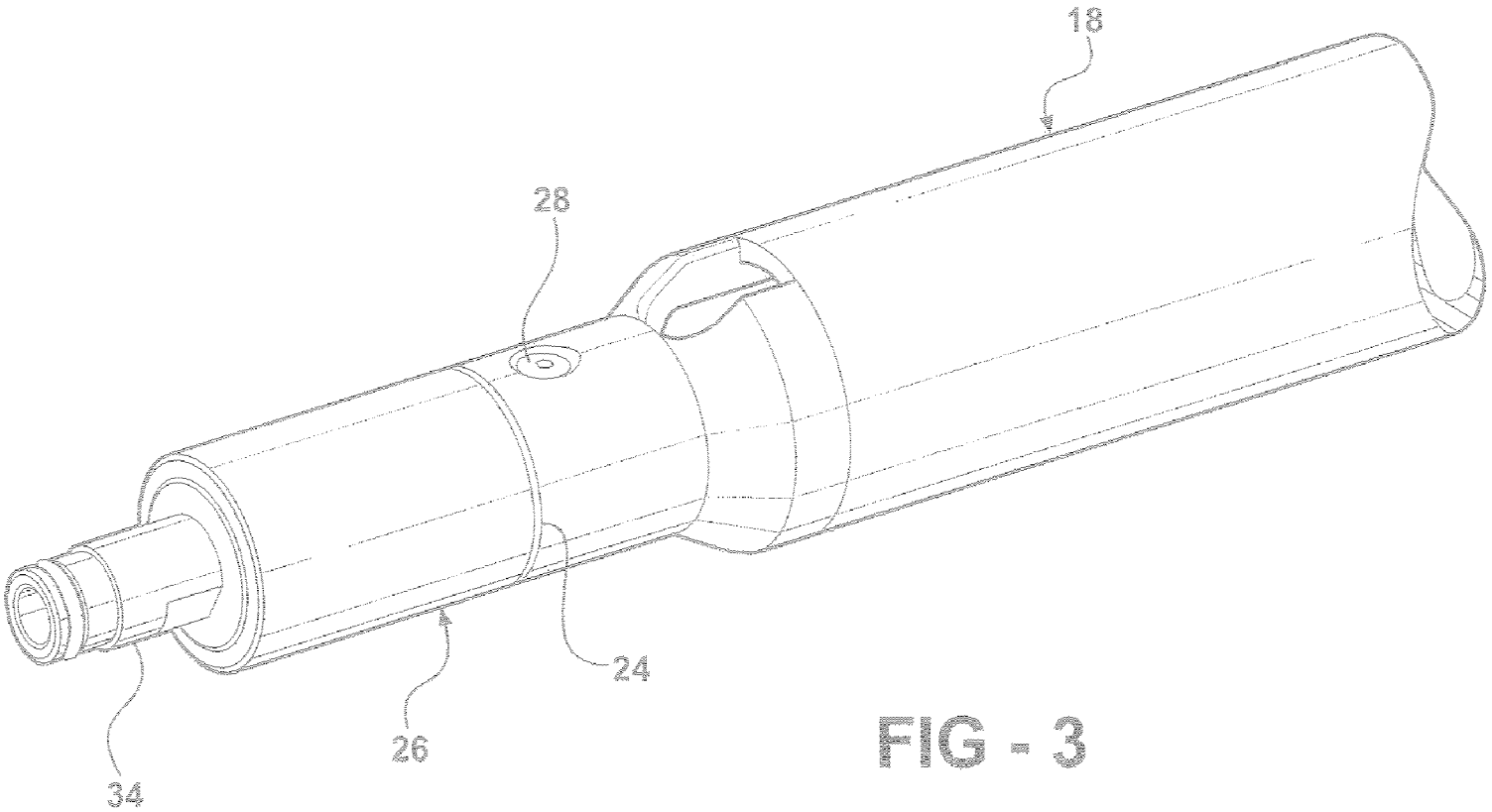
FIG. 3 is a perspective view of the rotating power connector connected to the unicable assembly.
Figure 4:
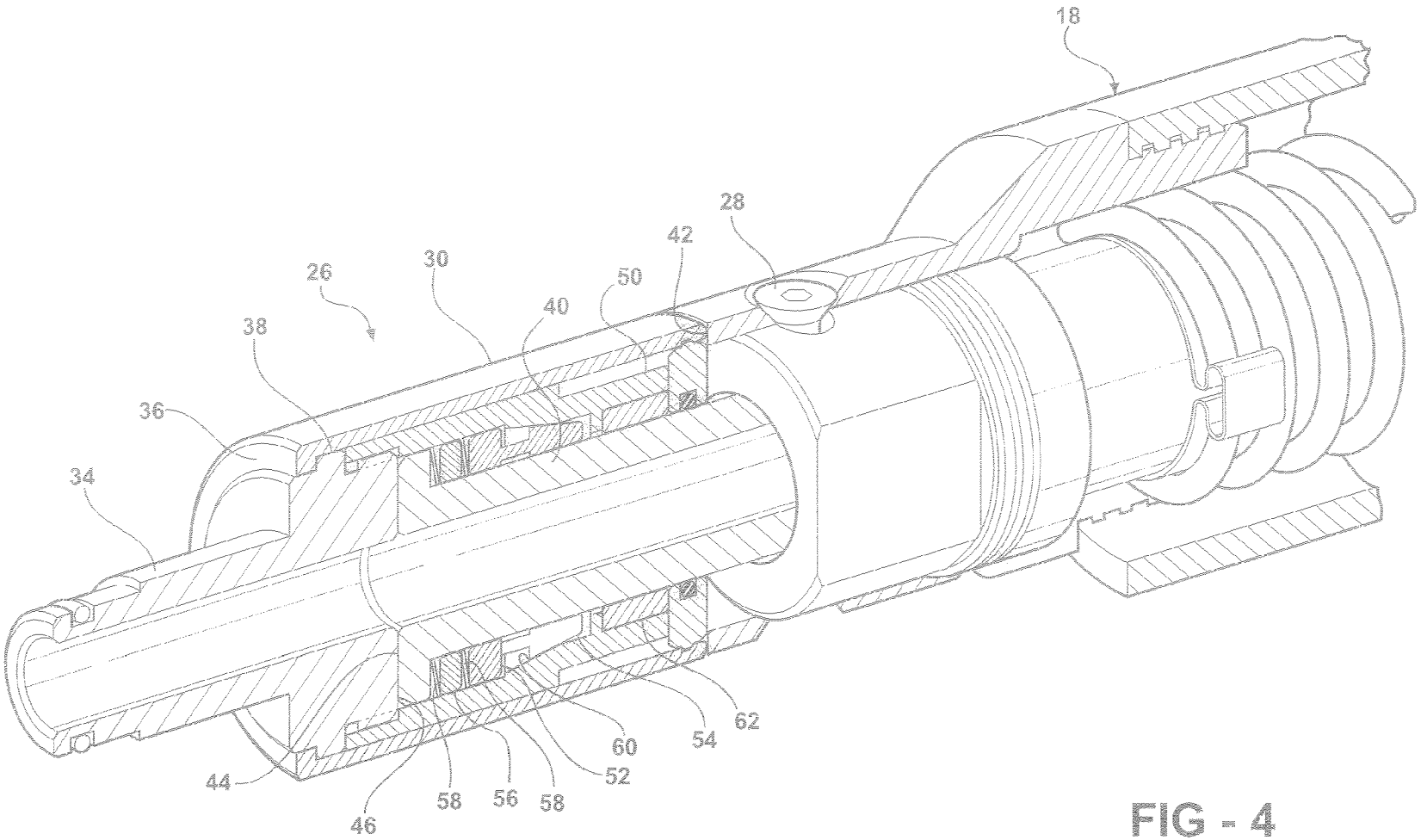
FIG. 4 is a partial sectional view of the rotating power connector and unicable assembly shown in FIG. 3.

Turning to FIGS. 2-4, and end 24 of the unicable 18 is connected to a rotating power connector 26. The unicable 18 may be permanently fixed to the rotating power connector 26 by one or more fasteners 28 such as locking screws, set screws, or similar. In this case, when the useful life of the rotating power connector 26 has ended, the entire assembly of the unicable 18 and rotating power connector must be discarded and replaced in order to replace the rotating power connector. Alternatively, the rotating power connector 26 may be a replaceable component that can be discarded and replaced with another rotating power connector by loosening the fastener(s) 28, separating the unicable 18 from the rotating power connector 26, and attaching a new rotating power connector to the unicable.

The rotating power connector 26 includes a generally cylindrical outer housing 30 having a longitudinal axis 32. A connector pin 34 is fixedly, axially disposed within the outer housing 30 and extends from one end 36 thereof. The connector pin 34 may be generally tubular with a flange portion 38 that secures the connector pin the outer housing 30. A rotating member such as a rotating stud 40 is rotatably, axially disposed within the outer housing 30 and extends from another end 42 thereof. The connector pin 34 and the rotating stud 40 have ends 44, 46, respectively, that are in contact within the outer housing 30. The rotating stud 40 is also generally tubular with a flange portion at its end 46. An opposite end portion 48 of the rotating stud 40 is disposed outside of the outer housing 30 and is insertable into and connectable to the end 24 of the unicable 18. An O-ring 49 or similar seals the end 42 of the outer housing 30 from which the rotating stud 40 extends.

An inner housing 50 is disposed within the outer housing 30. The inner housing 50 generally extends from one end 36 of the outer housing to the other end 42 and extends over the connector pin 34 and rotating stud 40. The inner housing 50 generally surrounds the rotating stud 40 and supports the ends 44, 46 of the connector pin 34 and the rotating stud. A secondary electrical contact ring 52 is disposed within the outer housing 30 and between the inner housing 50 and the rotating stud 40. The contact ring 52 encircles the rotating stud 40 and includes at least one contact portion 54 which is an extension that contacts the rotating stud. For example, the contact ring 52 may include eight contact portions 54, although the invention is not limited to any specific number of contact portions.

A slip ring 56 also encircles the rotating stud 40. The slip ring 56 may be made of brass or similar and is disposed on the rotating stud 40 between the contact ring 52 and the flanged end 46 of the rotating stud 40. A resilient biasing member 58 such as a wave spring or similar is disposed between the slip ring 56 and the flanged end 46 of the rotating stud 40. This biasing member 58 urges the rotating stud 40 in engagement with the connector pin 34. For example, when the rotating power connector 26 is connected to a welding torch 10, mating surfaces at the ends 44, 46 of the connector pin 34 and rotating stud 40 are forced into engagement by the biasing member 58. Another similar resilient biasing member 58 is disposed between the slip ring 56 and the contact ring 52. This biasing member 58 urges the contact ring 52 away from the slip ring 56 and towards the end 42 of the outer housing 30. The inner housing 50 includes a tapered surface 60 in contact with the contact portions 54 of the contact ring 52. The tapered surface 60 urges the contact portions 54 towards the rotating stud 40. As the biasing member 58 urges the contact ring 52 towards the end 42 of the outer housing 30, the contact portions 54 slide along the tapered surface 60 and urge the contact portions into engagement with the rotating stud 40.

A bearing 62 such as an oil impregnated bronze bearing or similar is disposed around the rotating stud 40 and between the rotating stud 40 and the inner housing 50. The bearing 62 facilitates rotational movement of the rotating stud 40 relative to the connector pin 34.

The rotating power connector 26 allows for the transfer of electricity. Electrical current may pass from the rotating stud 40 directly into the connector pin 34. For example, the connector pin 34 and rotating stud 40 may be made of an electrically conductive material such as brass or similar. Electrical current may also pass from the rotating stud 40 to the contact portions 54 of the contact ring 52, from the contact ring 52 into the inner housing 50, and from the inner housing 50 into the connector pin 34. For example, the inner housing 50 may be made of an electrically conductive material such as brass or similar, and the contact ring 52 may be made of an electrically conductive material such as terrilium copper or similar. The outer housing 30 may be made of an insulating material such as a plastic or similar, thereby shielding the outside of the rotating power connector 26 from the electrical current flowing through the inside of the rotating power connector.

The tubular connector pin 34 and tubular rotating stud 40 are axially aligned along the longitudinal axis 32 of the outer housing 30, forming a passageway. In this arrangement, the connector pin 34 and rotating stud 40 communicate welding shielding gas through the rotating power connector 26. A welding material such as welding wire also may travel through the same passageway.

Figure 5:
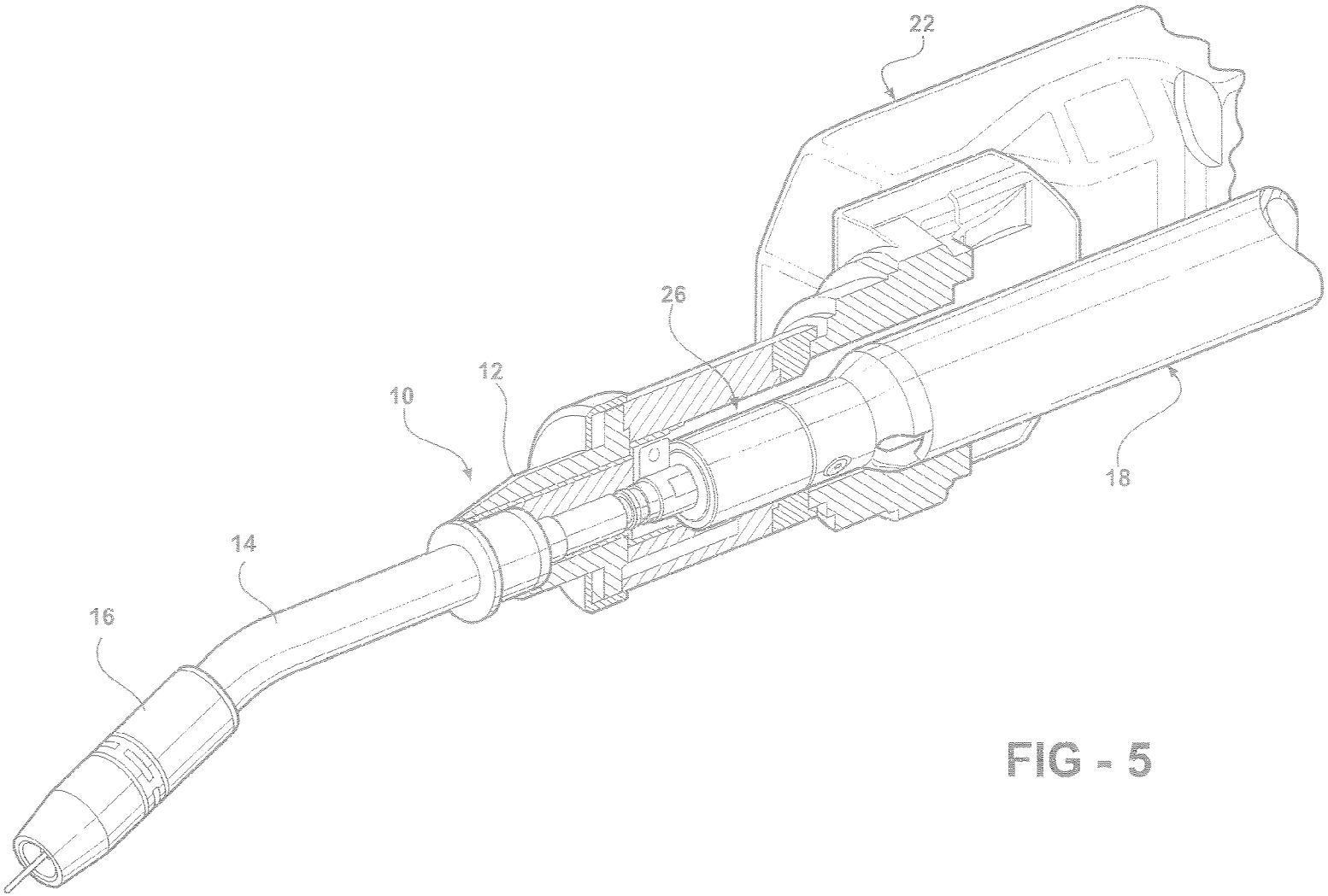
FIG. 5 is a partial sectional view of the rotating power connector and connected unicable assembly plugged into the welding torch shown in FIG. 1.

With reference to FIGS. 1 and 5, the rotating power connector 26 plugs into the main housing 12 of the welding torch 10, thereby connecting the unicable 18 to the welding torch. An O-ring or similar may seal the connection between the rotating power connector 26 and the welding torch 10. When connected to the welding torch 10, the rotating power connector 26 allows the unicable 18 to rotate relative to the welding torch. The rotatable movement of the unicable 18 provides relief to the otherwise rigid connection of the welding torch 10 and unicable 18, significantly reducing the amount of stress on the copper cables of the unicable and resulting in extended life of the unicable, which would normally fail under cyclical or repetitive torsion movements. The rotating power connector 26 also allows for the efficient passage of shielding gas from the unicable 18 to the welding torch 10, which is a required feature in processes such as a MIG welding process or similar. Electrical current and welding wire may also travel from the unicable 18 through the rotating power connector 26 and into the welding torch 10.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. A rotating power connector for an electric welding torch unicable, said rotating power connector comprising:

a generally cylindrical outer housing having a longitudinal axis;

a connector pin fixedly, axially disposed within said outer housing and extending from one end thereof;

a rotating stud rotatably, axially disposed within said outer housing and extending from another end thereof;

said connector pin and said rotating stud having ends in contact within said outer housing;

a secondary electrical contact ring disposed within said outer housing, said secondary electrical contact ring including at least one contact portion contacting said rotating stud; and at least one biasing member disposed between said rotating stud and said contact ring urging said rotating stud into engagement with said connector pin and urging said contact ring into engagement with said rotating stud.

2. The rotating power connector of claim 1, wherein said rotating stud and said connector pin are in electrical contact such that electric current flows therethrough.

3. The rotating power connector of claim 1, wherein said connector pin and rotating stud are tubular for communicating shielding gas therethrough.

4. The rotating power connector of claim 1, wherein said connector pin is insertable into a welding torch to connect the rotating power connector to the welding torch.

5. The rotating power connector of claim 1, wherein said rotating stud is connectable to an electric welding torch unicable.

6. The rotating power connector of claim 1, wherein said at least one biasing member is a wave spring.

7. The rotating power connector of claim 1, including a slip ring on said rotating stud, wherein one biasing member is disposed between said slip ring and a portion of said rotating stud and urges said rotating stud into engagement with said connector pin, and another biasing member is disposed between said slip ring and said contact ring urges said contact ring into engagement with said rotating stud.

8. The rotating power connector of claim 1, wherein said contact ring includes eight contact portions contacting said rotating stud.

9. The rotating power connector of claim 1, including a bearing around said rotating stud, said bearing facilitating rotation of said rotating stud relative to said connector pin.

10. The rotating power connector of claim 1, including an inner housing disposed inside of said outer housing and generally over said outer housing and said rotating stud and connector pin.

11. The rotating power connector of claim 10, wherein said inner housing includes a tapered surface in contact with said at least one contact portion of said contact ring, said tapered surface urging said at least one contact portion into engagement with said rotating stud.

12. The rotating power connector of claim 10, wherein said inner housing contacts said connector pin and said at least one contact portion of said contact ring to allow for the flow of electric current from said rotating stud through said contact ring and said inner housing into said connector pin.

13. An assembly for rotational movement of an electric welding torch unicable, said assembly comprising:

a connector that rotatably connects a welding torch unicable to a welding torch such that the unicable is rotatable relative to the welding torch;

said connector including:

a generally cylindrical outer housing having a longitudinal axis;

a connector pin fixedly, axially disposed within said outer housing and extending from one end thereof;

a rotating stud rotatably, axially disposed within said outer housing and extending from another end thereof;

said connector pin and said rotating stud having ends in contact within said outer housing;

a secondary electrical contact ring disposed within said outer housing, said secondary electrical contact ring including at least one contact portion contacting said rotating stud; and at least one biasing member disposed between said rotating stud and said contact ring urging said rotating stud into engagement with said connector pin and urging said contact ring into engagement with said rotating stud;

wherein the unicable, connector, and welding torch are in fluid communication, are electrically connected, and cooperate to define a passageway for a welding material.

14. The assembly of claim 13, wherein said connector communicates electrical current from said unicable to said welding torch.

15. The assembly of claim 13, wherein said connector communicates shielding gas from said unicable to said welding torch.

16. The assembly of claim 13, wherein said rotating stud of said connector is connectable to said unicable.

* * * * *